US009214267B2

(12) United States Patent
Bory et al.

(10) Patent No.: US 9,214,267 B2
(45) Date of Patent: Dec. 15, 2015

(54) ELECTROMAGNETIC ACTUATOR DEVICE

(75) Inventors: Raphael Bory, Eching (DE); Jonas Boll, Hamburg (DE); Daniela Haerter, Munich (DE); Robert Steyer, Munich (DE); Philipp Terhorst, Icking (DE); Thomas Schiepp, Seitingen-Oberflacht (DE); Markus Laufenberg, Stockhach (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 14/003,927

(22) PCT Filed: Mar. 15, 2012

(86) PCT No.: PCT/EP2012/054544

§ 371 (c)(1),
(2), (4) Date: Sep. 9, 2013

(87) PCT Pub. No.: WO2012/123537

PCT Pub. Date: Sep. 20, 2012

(65) Prior Publication Data

US 2014/0002218 A1 Jan. 2, 2014

(30) Foreign Application Priority Data

Mar. 16, 2011 (DE) ..... 10 2011 014 192

(51) Int. Cl.
*H01F 7/08* (2006.01)
*H01F 7/122* (2006.01)
*H01F 7/16* (2006.01)

(52) U.S. Cl.
CPC ..... *H01F 7/122* (2013.01); *H01F 7/1646* (2013.01)

(58) Field of Classification Search
CPC . H01H 9/443; H01H 1/54; H01H 2051/2218; H01H 50/44; H01F 2007/1692; H01F 41/02; H01F 5/00; H01F 7/0252; H01F 7/1607
USPC ..... 335/220
See application file for complete search history.

(56) References Cited

U.S. PATENT DOCUMENTS 4,321,570 A 3/1982 Tsunefuji
4,479,103 A 10/1984 Bailey et al.

(Continued)

FOREIGN PATENT DOCUMENTS

CH 318317 A 12/1956
DE 2823924 C2 12/1985

(Continued)

*Primary Examiner* — Shawki S Ismail
*Assistant Examiner* — Lisa Homza
(74) *Attorney, Agent, or Firm* — Bachman & LaPointe, PC

(57) ABSTRACT

An electromagnetic actuator device, comprising a coil unit, which surrounds a first yoke section of a stationary yoke unit and is activated by energizing the coil unit, and armature elements, which are guided so as to be movable relative to the yoke unit and which interact with an output-side actuating partner and are driven in order to perform an actuating movement, the armature elements interact with at least one second yoke section of the yoke unit to form an air gap lying outside of the first yoke section for a magnetic flux produced by the activated coil unit. Permanent magnet elements are connected magnetically parallel to the coil unit in such a way that a permanent-magnet magnetic flux of the permanent magnet elements through the first yoke section can occur, a coil magnetic flux of the coil unit flowing across the air gap is overlaid in a magnetically parallel and/or equally directed manner with a permanent-magnet magnetic flux of the permanent magnet elements flowing across the air gap, and activation of the coil unit by means of energizing causes an at least partial magnetic flux shift, in particular magnetic flux displacement, of the permanent-magnet magnetic flux of the permanent magnet elements from the first yoke section to the second yoke section.

18 Claims, 4 Drawing Sheets

(56) References Cited

U.S. PATENT DOCUMENTS

| | | | | |
|---|---|---|---|---|
| 4,808,955 | A * | 2/1989 | Godkin et al. | 335/222 |
| 5,155,399 | A * | 10/1992 | Zimmermann | 310/23 |
| 5,257,014 | A * | 10/1993 | Zimmermann | 340/686.1 |
| 5,303,012 | A * | 4/1994 | Horlacher et al. | 335/253 |
| 5,345,206 | A * | 9/1994 | Morcos | 335/222 |
| 5,787,915 | A * | 8/1998 | Byers et al. | 137/1 |
| 6,932,320 | B2 * | 8/2005 | Fukano et al. | 251/129.15 |
| 7,517,721 | B2 * | 4/2009 | Ito et al. | 438/106 |
| 7,746,202 | B2 * | 6/2010 | Hagen et al. | 335/274 |
| 8,159,807 | B2 * | 4/2012 | Pohl | 361/160 |
| 8,363,881 | B2 * | 1/2013 | Godkin | 381/414 |
| 8,576,032 | B2 * | 11/2013 | Herbert et al. | 335/220 |
| 2005/0024174 | A1 * | 2/2005 | Kolb et al. | 335/220 |

FOREIGN PATENT DOCUMENTS

| | | | |
|---|---|---|---|
| DE | 102008028125 | A1 | 12/2009 |
| EP | 0018352 | A1 | 10/1980 |
| FR | 2713820 | A1 | 6/1995 |

* cited by examiner

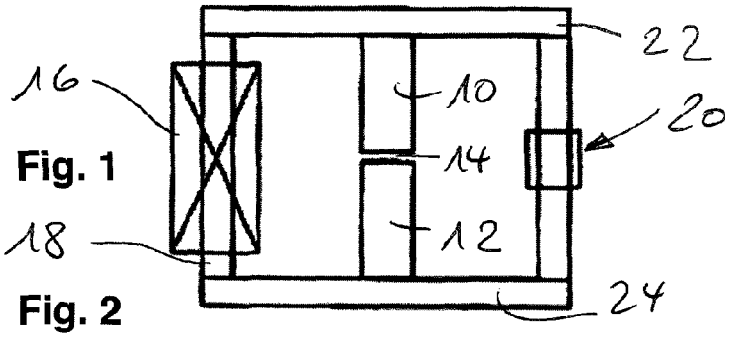
Fig. 1
Fig. 2
Fig. 3
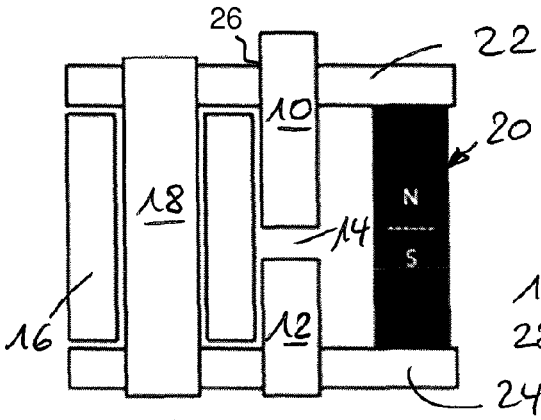
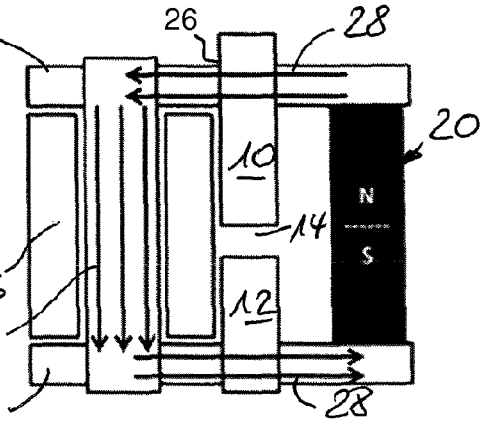
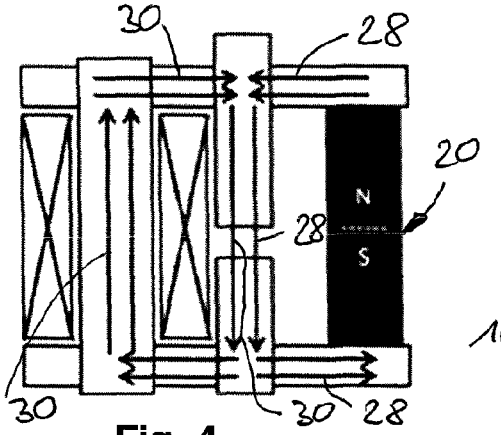
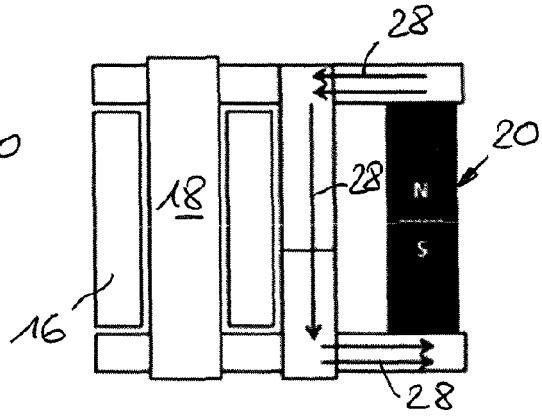
Fig. 4
Fig. 5
Fig. 6
Fig. 7
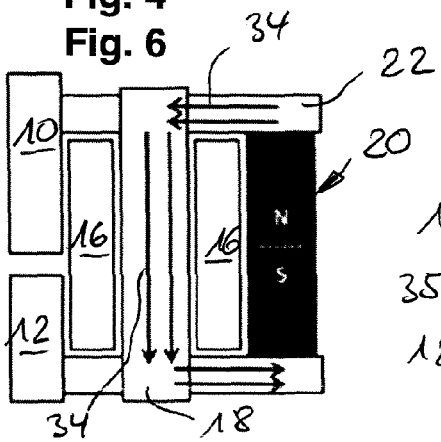
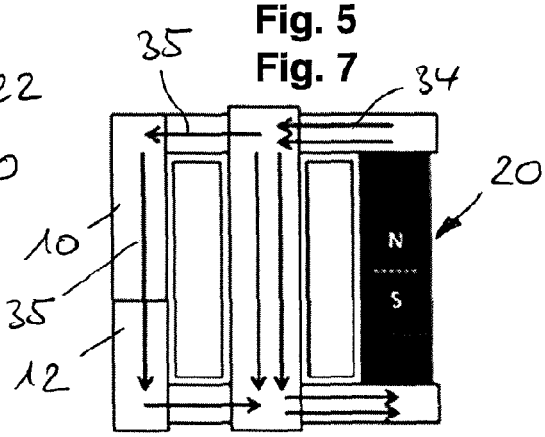

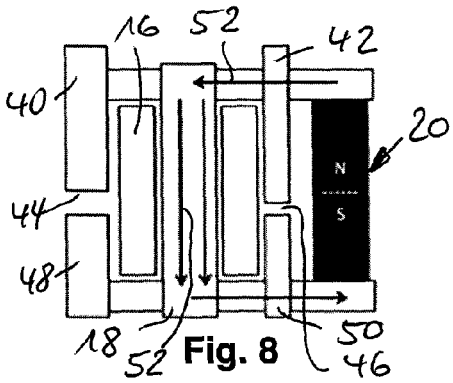
Fig. 8
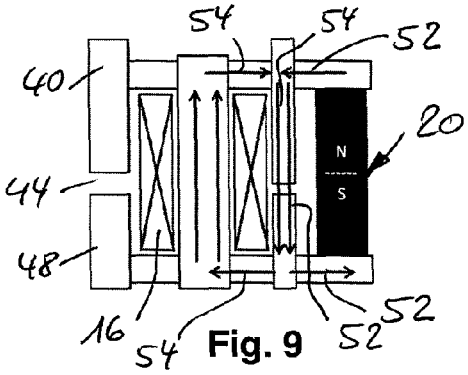
Fig. 9
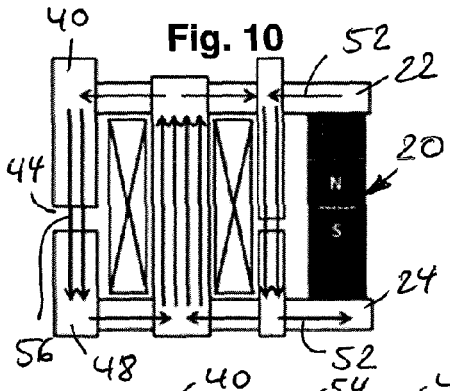
Fig. 10
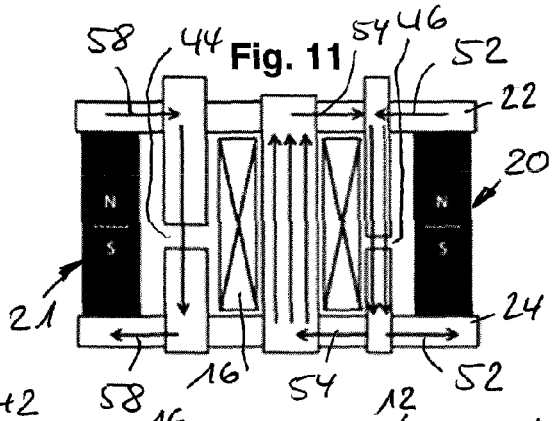
Fig. 11
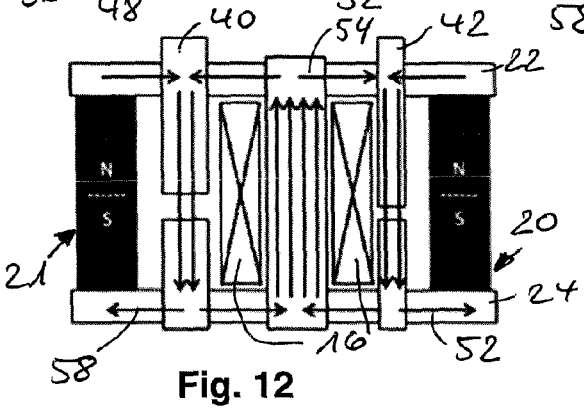
Fig. 12
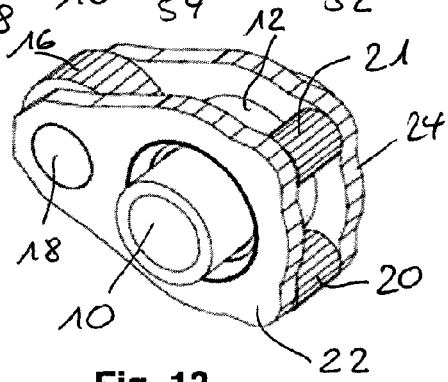
Fig. 13
Fig. 14
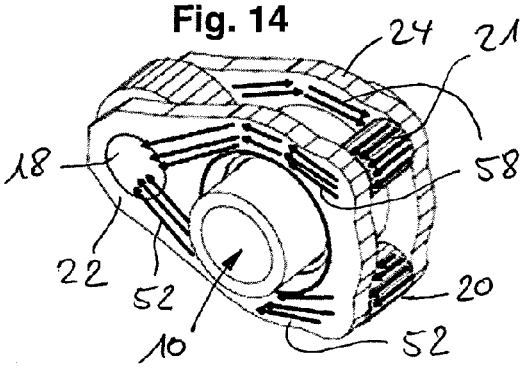
Fig. 15
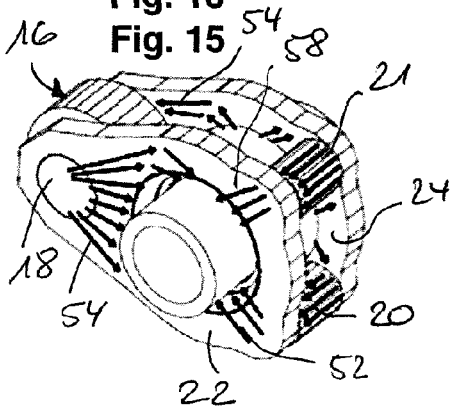

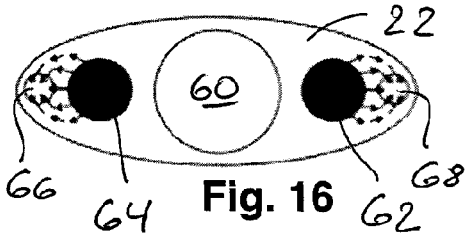
Fig. 16
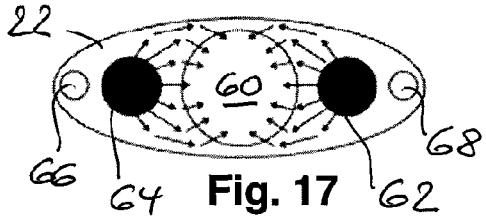
Fig. 17
Fig. 18
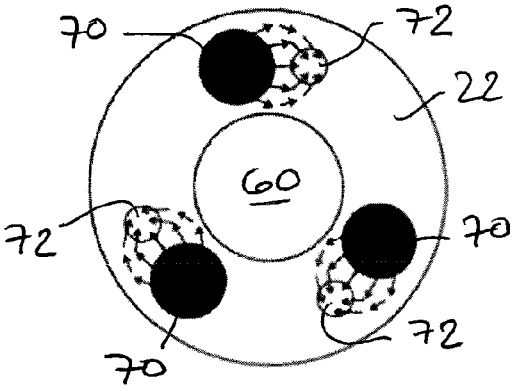
Fig. 19
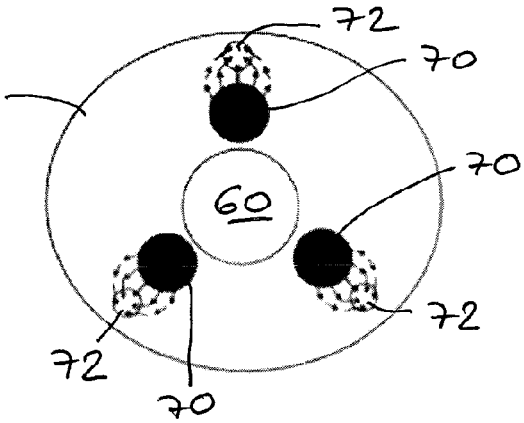
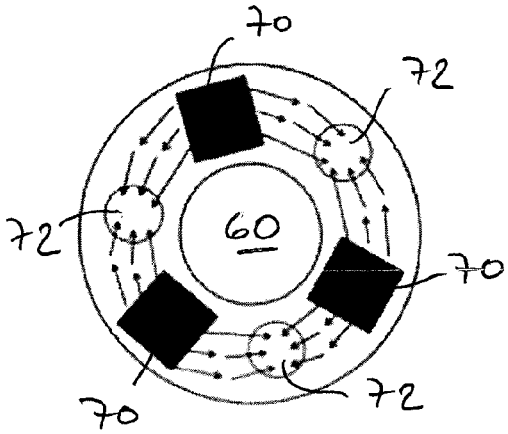
Fig. 20
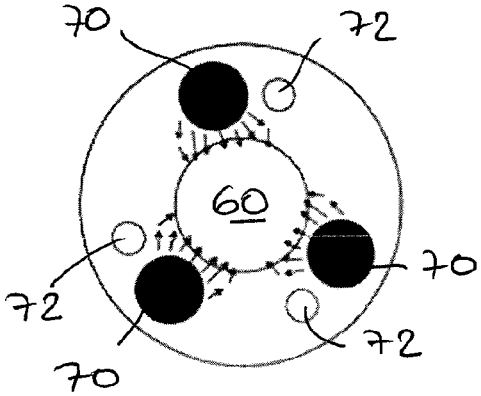
Fig. 21
Fig. 22
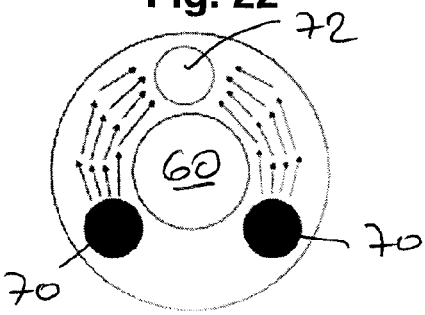
Fig. 23
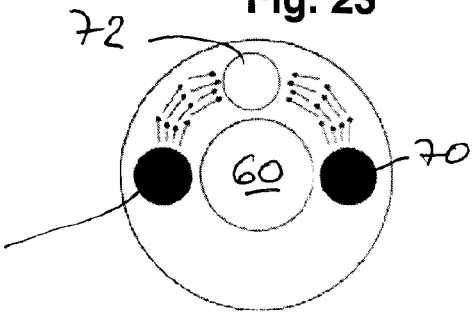

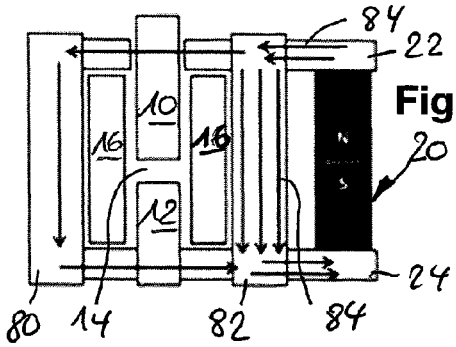
Fig. 24
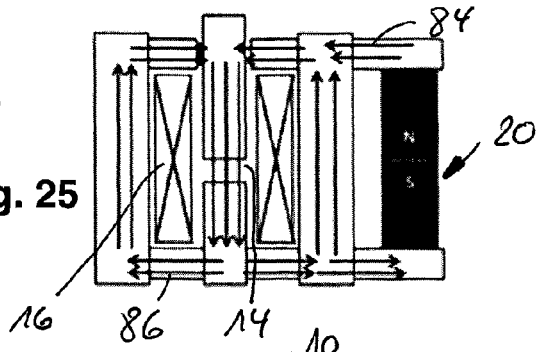
Fig. 25
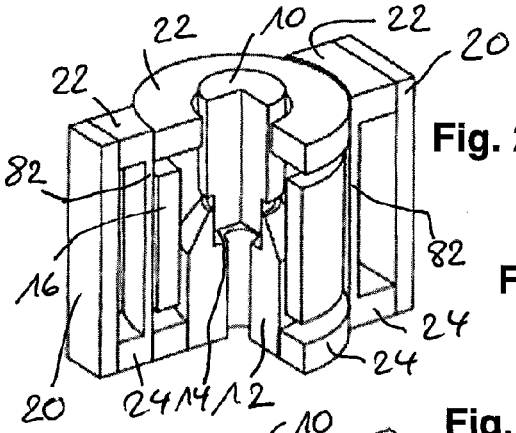
Fig. 26
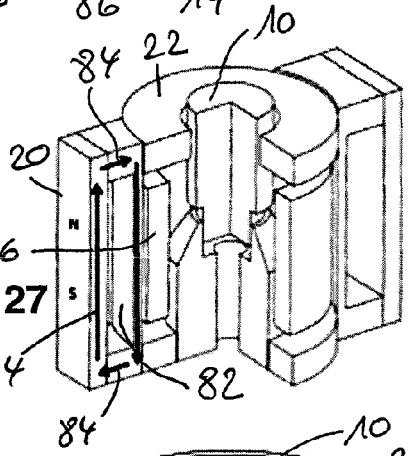
Fig. 27
Fig. 28
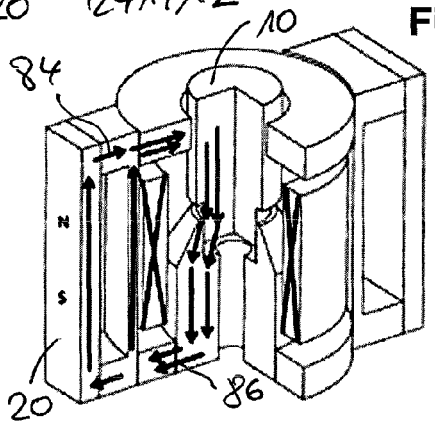
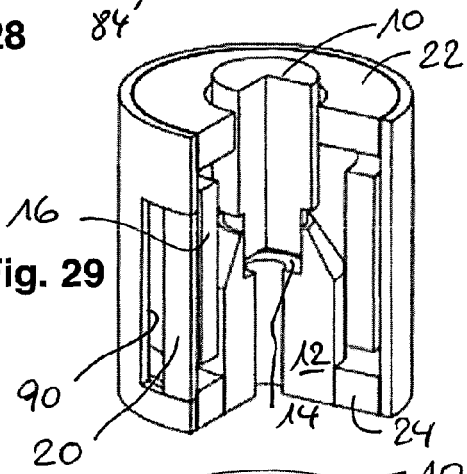
Fig. 29
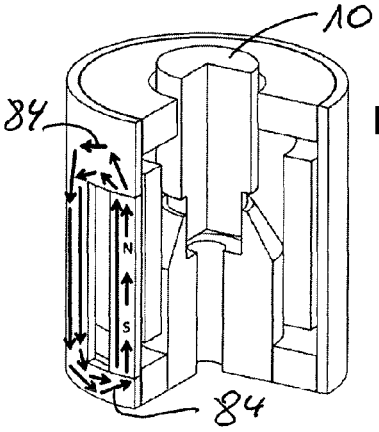
Fig. 30
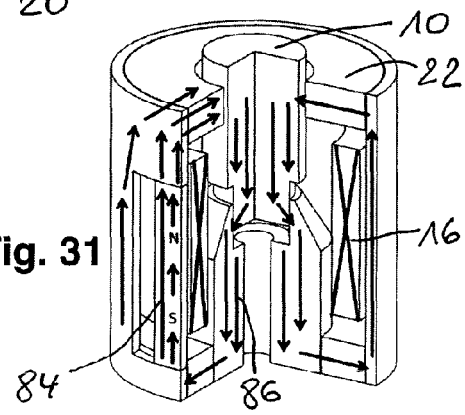
Fig. 31

ELECTROMAGNETIC ACTUATOR DEVICE

BACKGROUND OF THE INVENTION

The present invention concerns an electromagnetic actuator device.

In such devices a coil unit (typically cylindrical in cross-section) is provided on a stationary yoke unit such that it encloses a first yoke section of the yoke unit and when energised introduces a magnetic flux into the yoke unit. This coil magnetic flux then interacts across a (working) air gap with the armature elements, which in turn execute the desired actuator movement, i.e. a positioning movement for an output-side positioning partner. Here it is on the one hand presupposed to be a generic feature, in the manner of a laterally outwardly mounted coil, to provide the coil unit with the related first yoke section spaced apart from the second yoke section forming the air gap, i.e. to provide the air gap completely outside the first yoke section. While this material originates from the applicant's internal, unpublished prior art, it is on the other hand, in turn a generic feature, presupposed to be of known art, that the coil unit at least partially, i.e. in some sections, encloses the (working) air gap (and in this respect also interacts directly with the armature agents); this corresponds to the functional operation of typical electromagnetic actuators provided axially along the linear direction of movement of the armature.

Both generic principles have certain advantages in each case; thus, for example, the approach first cited enables by means of the activation (energisation) of the coil unit a specific influence of the flux in the magnetic flux circuit formed by the yoke unit, typically having a plurality of arms. In contrast it can here be established as potentially disadvantageous that the coil efficiency of the coil unit (as a result of the occurrence of undesirable stray fields) is non-optimal, moreover, concepts such as the outwardly mounted coil have the problem of possible transverse forces acting on the armature unit as a result of the coil magnetic flux, i.e. forces (or force components) which not (only) extend along the linear armature direction of movement, but in addition cause a tendency to tilt, and in this respect cause wear; in particular these reduce the suitability of such devices for low wear continuous operation.

In contrast the generic principle of the armature unit enclosed or covered by the coil unit is less affected by such transverse forces, however, for example, the design-related options for introducing additional magnetic flux into the armature unit (via the working air gap) are limited and are primarily determined by the coil dimensions. As a result disadvantages occur in turn with regard to the utilisation of and/or adaptation to build spaces that are available, possible thermal or winding losses or similar disadvantages. In addition, for example, when utilising such an electromagnetic actuator device for purposes of valve control, the enclosure of the armature unit, in this respect operating effectively on the valve, by means of the coil unit offers the problem of limited supply and removal options for a particular fluid that is to be influenced by the valve.

The object of the present invention is therefore to improve an electromagnetic actuator device with regard to rendering the magnetic flux in the stationary yoke unit more flexible, in particular with regard to creating the possibility of adapting such an electromagnetic actuator device (potentially at the same time as optimising its efficiency) to build space limitations and/or of minimising possible wear.

SUMMARY OF THE INVENTION

The object is achieved by the electromagnetic actuator device of the present invention wherein, in a first aspect of the invention, permanent magnet agents are magnetically connected in parallel to a coil unit such that an (additional) permanent magnetic flux of the permanent magnetic agents can occur via the first yoke section (on the coil unit), in this respect, at least with the coil unit deactivated, a magnetic short-circuit of the permanent magnetic agents occurs. At the same time it is inventively established that a coil magnetic flux of the coil unit flowing across the (preferably single) air gap magnetically parallel and/or in the same direction is superposed on a permanent magnetic flux of the permanent magnetic agents flowing across the air gap; in this respect it is achieved that at least with the energisation of the coil unit the permanent magnetic flux (or at least a component of the same) flows across the air gap such that in the case of such an activation of the coil unit by means of energisation an at least partial magnetic flux relocation of the permanent magnetic flux from the first yoke section (namely the continuous section of the coil unit that is free of air gaps), flows into the second yoke section interacting with the (working) air gap and accordingly this flux shift or flux displacement leads to an influence on the positioning or switching characteristic of the armature unit interacting with the air gap.

In other words the present invention, in accordance with the first aspect of the invention in accordance with the main claim, advantageously causes that as a reaction to the energisation of the coil unit the coil magnetic flux thereby generated causes the shift or displacement of the permanent magnetic flux of the permanent magnetic agents. In this manner the coil magnetic flux generated by the coil assumes the character of a field opposing that of the permanent magnet, and can in this respect influence the permanent magnetic flux efficiently, potentially (relative to the coil magnetic flux) in a manner increasing the flux, in the simplest case with regard to the switching on or off of a particular arm.

This inventive action appears to be of particular interest and practically beneficial if, in an alternative to the permanent energisation of the coil unit this activation takes place purely in the form of a pulse, as is foreseen as per further developments, and then, as a reaction to this pulsed form of activation (and an already thereby evoked relocation or reaction of the movement units of the actuator device involved), a monostable or bi-stable switching characteristic is achieved. This is the case, for example, if as a reaction to the pulsed form of energisation of the coil unit an armature movement thereby caused (which then in a suitable manner displaces at least a part of the permanent magnetic flux into the air gap and in this respect increases the armature force) leads to a closure of the air gap. This can advantageously cause that in this switching state the permanent magnet flux (for example, by virtue of a lower magnetic resistance of the second yoke section with a reduced or closed air gap) primarily flows through this second yoke section, in this respect this armature position closing the air gap is then stably held by the action of the permanent magnetic agents, without, for example, the need for any further renewed energisation of the coil unit. Thus a bistable device is achieved.

If in turn in the further development of the invention a restoring device, for example, in the form of a compression spring or a restoring spring, is assigned to the armature agents, against which the armature operates in the above-described manner, by means of a suitable setting, for example, of the spring force, the movement and/or switching behaviour of the armature unit can be further influenced, for example can be configured as a monostable variant, wherein, after completion of the energisation pulse, a (spring-) restorative force of sufficiently large dimensions brings the armature unit back into its initial position against the force action of the permanent magnetic flux.

Again additionally or alternatively in a manner of otherwise known art, through the adjustment of an effective separation distance for the armature unit, i.e. the air gap (e.g. by the deployment of suitable non-magnetic non-stick or non-adhesive disks on the second yoke section) can the detainment and movement characteristics be influenced, in that, for example, such a non-magnetic separation distance retainer increases the air gap between armature and yoke.

In all these forms of implementation it is both covered by the invention and possible within the context of suitable designs, to design the permanent magnetic agents in the form of an individual magnetic element (preferably of elongated design and axially magnetised along the direction of extension), as is also the deployment of a multiplicity of such permanent magnet elements, which are then provided at suitable positions, in particular opposing with regard to the air gap and/or the coil unit; in the same way the present invention covers the provision of the armature agents in the form of a multiplicity of suitably guided, i.e. mounted armature units, also independent of one another, wherein then the inventive second yoke section correspondingly implements a plurality of regions, i.e. sections, of the yoke unit.

Also provision is made, again in terms of adaptation to particular fields of deployment, in an advantageous and sensible, but not limiting, manner, to provide an axial direction of extension (again corresponding to a magnetisation direction) of the permanent magnetic agents approximately on an axis parallel to a linear direction of movement of the (at least one) armature unit (or tilted or inclined with regard to the axial direction of extension by an angle of not more than 10°), again as per further developments to configure a direction of extension of the (surrounded by the coil unit) first yoke section parallel to these axes (or to one of these), again as per further developments and advantageously to establish the coil unit with a coil axis or a coil longitudinal axis such that an armature direction of movement takes place parallel to the coil longitudinal axis. All of these further developments can also be deployed independently of one another within the context of the invention with advantage.

In particular against a background of the object, as set, of the actuation of a multiplicity of armature units by means of a common coil unit, provision is made as per further developments and preferably to provide the respective related second yoke sections of these armature units suitably adjacent and/or distributed around the periphery, with regard to the coil unit, so as to be able to implement geometrical or spatial advantages in this respect.

This flexibility applies additionally or alternatively as per further developments also for the possibility of positioning the inventive permanent magnetic agents in the form of a multiplicity of individual permanent magnet elements distributed and/or positioned at predetermined positions relative to the coil unit and/or to at least one armature unit (i.e. the respectively related armature sections). Thus it is possible, additionally and advantageously, in addition to an (installation) space optimisation, in particular also to optimise the above-described transverse force problems on the armature agents, in that particular (operational) magnetic flux components of the coil unit on the one hand as well as the permanent magnetic flux components of the permanent magnetic elements on the other hand are thus brought into equilibrium in terms of flux, such that the disadvantageous transverse force effects on the armature agents (of one individual armature unit, also, potentially as per further developments, a multiplicity of armature units) are minimised.

It is particularly advantageous in the context of such preferred further developments of the invention to connect the respective flux-generating components, i.e. components reacting to the magnetic flux (coil unit with first yoke section, armature agents with second yoke section and air gap, permanent magnetic agents) by means of flux-conducting elements, further preferred in each case at both ends with the formation of a magnetic parallel connection, i.e. a flux-conducting arrangement of at least two flux-conducting circuits, wherein it has been shown in terms of design and magnetic characteristics to be particularly preferable to provide such flux-conducting elements (which in particular can also be implemented as sections of the e.g. one-piece yoke unit, alternatively in modular form assembled from predetermined modules) such that they run at right-angles to a (linear) direction of movement of the at least one armature unit, i.e. at right-angles to a magnetisation direction of the at least one permanent magnet unit, or at right-angles to a longitudinal direction of the first yoke section (and thus at right-angles to a direction of extension of the coil unit). Such a flux-conducting element, which further preferably can be provided at both ends of the cited magnetic components, can suitably be configured as a flat module (for example as platelets), and/or can use a design, which possesses at least one flat side, so that beneficially, for example, otherwise of known art magnetic flux-conducting sheets (which moreover in terms of production technology can beneficially be stamped out and are thus suitable for large scale production) can be used suitably stacked for purposes of implementation of the various sections of the yoke unit.

In the further optimisation of the present invention, in particular in the case of a multiplicity of (individual) magnet elements provided and individual coils of the coil device, it is, for example, possible, for purposes of implementation of the above-described invention principle, to arrange the permanent magnet unit and coil unit relative to one another in pairs, so that, with respect to one such pair, in each case the permanent magnetic flux can flow through the first yoke section of the related coil unit, while an energisation of the respective coil units inventively displaces the permanent magnetic, flux for purposes of influencing the armature movement, into the at least one second yoke section for one or a plurality of armature units. In the context of optimisations for a particular arrangement geometry (i.e. as a function of particular installation conditions) such pairs of coil units/permanent magnet units would then again as per further developments be suitably aligned relative to the armature agents, for example, suitably in the shape of a curve and/or circle about the armature centre, in turn suitably and further preferably magnetically coupled via flux-conducting elements engaging at one or both ends.

In accordance with a second aspect of the invention, the permanent magnetic agents are used so as to influence the magnetic flux and positioning characteristics of an electromagnetic actuator device, in which the coil unit at least partially encloses the working air gap and/or the armature agents, that is to say, no laterally outwardly mounted arrangement is present as in the first aspect of the invention.

Nevertheless here too a flux-conducting section of the yoke unit of the coil unit is provided outside of the first yoke section, for purposes of forming at least one magnetic flux path that is free of air gaps. In the context of this aspect of the invention permanent magnetic agents are magnetically connected in parallel with the coil unit, such that in a de-energised state of the coil unit a permanent magnetic flux of the permanent magnetic agents is guided via this flux-conducting section, so that in this respect the flux-conducting section acts as a magnetic short-circuit for the permanent magnetic agents, if the coil unit is not activated.

Following the above overall concepts of the invention, an activation of the coil unit by means of energisation causes, however, at least a partial relocation of the magnetic flux, in particular a displacement of the permanent magnetic flux from the flux-conducting section of the yoke unit in the first yoke section (and thus across the air gap) with the consequence that by this means the armature force is then influenced. In this respect this aspect of the invention also thus enables advantageously that as a reaction to an activation of the coil unit a permanent magnetic flux, which is additionally coupled into the system in a flux-conducting manner, is specifically influenced, in particular is switched on and off with regard to the first yoke section and the armature unit.

In this aspect of the invention the possibilities discussed in the introduction also apply, of configuring geometrically the respective magnetically effective sections into one or more parts, wherein for example a preferred form of implementation of the invention envisages that the inventive flux-conducting section (for the guidance of the permanent magnetic flux in the de-energised state of the coil unit) forms at least two flux conducting arms running magnetically parallel to one another, which can, for example, be preferably provided adjacent to the coil device on the cover side, further preferably facing one another with regard to the coil device.

In a particularly preferred manner the flux-conducting section is designed moreover, for example, as a section or region of a flux-conducting housing (in particular a housing shell) of the actuator device, wherein this housing shell encloses the coil unit on the cover side as per further developments and the permanent magnetic agents are provided either on or in the housing shell to achieve the described flux guidance; it is particularly advantageous if for example a direction of magnetisation of the permanent magnetic agents runs parallel to a direction of movement of the armature agents, so that in this case then, with a typical sleeve or cylinder shaped housing, a direction of extension and magnetisation direction of the permanent magnetic agents also runs parallel to an axial direction of the sleeve or cylinder.

Additionally or alternatively it is possible that the permanent magnetic agents, again as per further developments, are externally placed in the described relative alignment on a (closed) housing section of the housing shell, so that in this respect the lateral (short-circuit) magnetic flux can again flow in the de-energised state of the coil unit; an alternative form of implementation could envisage that the (elongated) permanent magnetic agents are provided in a suitably dimensioned recess (slot or gap) of the housing shell, at its ends coupled in a flux-conducting manner.

The possibilities provided as per further developments, to connect the permanent magnetic agents and the first yoke section (with the coil unit) via flux-conducting regions, i.e. flux-conducting elements, running suitably at right-angles to the respective direction of extensions, also apply for this aspect of the invention, wherein these flux-conducting elements again can be implemented in a manner suitable for large-scale production as a component of the yoke unit, flat as per further developments and/or with the aid of individual sheets or sheet stacks.

As a result there is generated by means of the present invention of two aspects of invention a surprisingly effective, high quality flexible system of coil unit, armature agents and permanent magnet unit, which combines the possibility of an optimised mechanical arrangement and/or build space utilisation with a magnetic flux optimisation for purposes of module dimensioning, loss minimisation (with regard to the coil unit, for example) and the prevention of undesirable possible transverse forces with regard to the armature unit, so that in this respect wear optimisation is also enabled.

BRIEF DESCRIPTION OF THE DRAWINGS

Further advantages, features, and details of the invention ensue from the following description of preferred examples of embodiment and also with the aid of the drawings; these show in:

FIG. 1: a schematic diagram to clarify the essential functional components of the first aspect of the invention and their interaction with one another;

FIG. 2 to FIG. 5: the interaction of the functional components in accordance with FIG. 1 in energised operation for purposes of achieving bistability;

FIGS. 6, 7: a variant for the implementation of FIG. 1 with a deviation in the guidance of the permanent magnetic flux;

FIG. 8 to FIG. 12: further variants of the first aspect of the invention with a multiplicity of armature units, i.e. a multiplicity of individual permanent magnet elements in the framework of a parallel arrangement connected by flux-conducting agents;

FIG. 13 to FIG. 15: a concrete implementation of the first aspect of the invention shown in perspective and as a mechanical design with an arrangement of a coil unit and a pair of permanent magnets, which on both sides are connected by flat flux-conducting agents;

FIGS. 16, 17: a schematic topographical presentation of a design variant of FIGS. 13 to 15 with two coil-permanent magnet pairs arranged in pairs, on both sides adjacent to the armature unit;

FIG. 18 to FIG. 21: further arrangements with coil-permanent magnet pairs in a circular-peripheral assignment to a central armature unit;

FIGS. 22, 23: asymmetric variants in the assignment of permanent magnets and coil in an analogous manner to the configurations of FIGS. 18 to 21;

FIGS. 24, 25: representations of principles to clarify the second aspect of the invention with the coil device enclosing the armature unit, i.e. the air gap;

FIG. 26 to FIG. 31: various design variants of the assignment of permanent magnetic agents to a housing cover (as a flux-conducting section) and therein with magnetic fluxes generated with a de-energised or an energised coil.

DETAILED DESCRIPTION

With the aid of FIGS. 1 to 5 the general design and magnetic principles are described together with a possible (e.g. bistable) operating mode of the present invention. Thus the device, shown schematically in FIG. 1 and shown analogously in FIG. 2 with the functional components, has an electromagnetic actuator device, which has armature agents or units 10, moveably guided, moveable axially (i.e. directed upwards in the respective plane of the figure) relative to a yoke section 12 (the second yoke section in the context of the invention). Between the armature agents 10 and the yoke section 12 a variable (preferably single) air gap 14 is formed, corresponding to a separation distance between armature unit 10 and yoke section 12, across which, as a working air gap, a magnetic flux is guided, so as in this respect to undertake an application of force onto the armature unit 10 for purposes of driving the same.

The yoke section 12 is a component of a (stationary, i.e. held or secured such that it cannot move) yoke unit, essentially consisting of a yoke section 18 (the first yoke section in the context of the invention, also designated as the coil core) assigned to a coil or coil unit 16 provided in an adjacent arm. Furthermore a permanent magnet unit or element 20 is held in an opposite arm of the yoke unit, wherein flux-conducting sections 22, 24, in the example represented on both sides of the permanent magnet unit 20 and also on both sides of the coil unit 16 (i.e. of the related yoke section) connect the flux-conducting components, in the example of embodiment represented create approximately centrally a magnetic flux connection to the yoke section 12 and, as indicated in FIGS. 2 to 5, provide a gap 26 to allow the armature unit 10 to pass through (and in this respect for purposes of introducing a magnetic flux into the armature unit for the air gap 14, i.e. the yoke section 12). In this configuration of the stationary yoke unit, the respective longitudinal axes, i.e. the axes of movement of the participating components are here aligned adjacent and parallel to one another for purposes of achieving a compact arrangement. A coil longitudinal axis, defined by the direction of extension of the yoke section 18, runs in parallel to the direction of extension (and direction of magnetisation) of the elongated design of the permanent magnet element 20, and in parallel to the direction of extension and direction of movement of the armature unit 10.

FIG. 3 illustrates a flux path in the de-energised state of the coil unit 16 in the arrangement just schematically shown in FIG. 1 and FIG. 2, wherein the cluster of arrows 28 just illustrates the (permanent) magnetic flux caused by the permanent magnet unit 20. Since in the arrangement of FIGS. 1 to 4 the air gap 14 is open, and in this respect provides an increased magnetic flux resistance compared with the yoke section 18, practically the whole permanent magnetic flux in this state of armature position runs, as illustrated in accordance with the arrow arrangement 28 in FIG. 3, via the yoke section 18, so that in this respect a magnetic short-circuit of the permanent magnet unit 20 occurs via the first yoke section 18 (core section) of the coil unit 16.

If then, as shown in FIG. 4, the coil 16 is energised, a coil magnetic field occurs, which causes the coil magnetic flux illustrated by the cluster of arrows 30. The polarity of the coil unit is such that a magnetic flux flowing in the yoke section 18 is directed against the direction of the permanent magnet (in section 18), so that by the action of the coil magnetic flux 30 not only is the (further) entry of the permanent magnetic flux 28 into the yoke section 18 prevented, but rather this permanent magnetic flux (also illustrated in FIG. 4 with the reference symbol 28 as a cluster of arrows) is displaced into the armature unit 10 and the second yoke section 12. Since, moreover, the permanent magnet unit 20 opposes the coil magnetic flux 30 with a greater resistance than does the sequence (or central arm) of armature unit 10, air gap 14 and yoke section (stator) 12, the coil magnetic flux 30, in this respect for purposes of closing this magnetic flux circuit, is displaced into this central arm.

As a result, as illustrated in FIG. 4 in terms of the magnetic fluxes directed parallel to one another through the armature unit and across the air gap, both the coil magnetic flux 30 and also the permanent magnet flux 28 mutually run effectively across the working air gap, summating their action accordingly and thus cause, by the energisation of the coil unit 16, to ensure that a common, superposed and summated magnetic flux acts on the armature unit and drives the latter (so as to close the air gap 14).

The result of this drive process is shown in the presentation in FIG. 5, with a coil unit that is again deactivated (so that, as the above description of the example of embodiment of FIGS. 2 to 5 indicates, a temporary, e.g. a pulse-form energisation of the coil unit 16 is sufficient to move the armature unit 10 that is in a first, disconnected, i.e. open state, into a second contact state that closes the air gap (FIG. 5). Moreover it can be discerned that the permanent magnetic flux 28 now flowing through the sequence of armature unit 10—yoke section 12 seeks to provide for a stable contact position of the armature unit 10 on the yoke section 12 (while practically no permanent magnetic flux, or just a negligible component of the permanent magnetic flux, flows via the yoke section 18 assigned to the coil unit 16, since the now closed armature position provides a lower magnetic flux resistance).

In this manner a bistable mode of operation of the electromagnetic actuator device is demonstrated, which is stable with zero current in each of the armature positions shown. At the same time if it were necessary in the case of the configuration shown to bring about again a reset of the armature unit 10 from the lower contact position of FIG. 5 into the open position (FIGS. 2 to 4) this can, for example take place via the introduction of an external force (not shown in any detail in the figures), as is of known art, for example, in terms of a valve lift adjustment of cam shafts or similar, additionally or alternatively via the provision of a spring or similar energy store, against which, for example, the armature unit 10 operates, and which then, with the cessation of the energisation of the coil 16, guides the armature unit back into an upper position that opens the air gap.

Also it would be possible, for example, for purposes of reducing a possible reset force of the armature, to energise the coil unit 16 temporarily in reverse in a suitable manner.

The example of embodiment of FIGS. 6, 7 reverses the arrangement of the arm adjacent to the permanent magnetic agents; here the (first) yoke section 18 assigned to the coil unit for purposes of forming a magnetic flux circuit (in the manner of a short-circuit) is provided axially adjacent to the permanent magnet unit 20; the axially aligned with one another and moveable arrangement comprising the stationary yoke section 12 and axially moveable armature unit 10 is then adjacent to the yoke section 18.

As the permanent magnetic flux illustration of FIG. 6 shows (with the coil unit deactivated) a permanent magnetic flux 34 flows through the yoke section 18, in this respect leaving the arm formed from armature and yoke section 12 together with the air gap 14 outside the flux path. An activation of the coil unit 16 then causes, in an analogous manner to the above-described example of embodiment, the addition or superposition of permanent and coil magnetic flux in the air gap arm to move the armature unit so as to close the air gap, so that, after a renewed deactivation of the coil unit, the bistable state of FIG. 7 ensues. Since, however, by virtue of the closed air gap the arm formed from the yoke section 12 and armature unit 10 has a reduced magnetic resistance compared with the open air gap of FIG. 6, a permanent magnetic flux component 35 also flows through this arm, in this respect subdividing the permanent magnetic flux of the permanent magnet 20. Nevertheless a relatively larger, more significant flux component flows, now as before, through the yoke section 18.

The result is that in comparison to the situation of FIG. 5 in the first described example of embodiment, lower restoring forces are required so as to release the armature unit 10 from the position of FIG. 7 of the related yoke section 12. If then in addition another distance element, or anti-stick element, of non-magnetic material, otherwise of known art, is used on the end face, i.e. contact side of the yoke element 12 in the direction onto the armature unit 10, as a result of thereby achieved effective increase of the air gap (in the contact state)

the holding force (FIG. 7) can be further reduced, so that for particular applications suitable configuration and design options are available.

The example of embodiment of FIGS. 8 to 10 illustrates a variant of the invention, in which a permanent magnet unit is operated together with a multiplicity of armature units interacting across a respective working air gap with a stationary yoke section. Here, with respect to the armature units 40 and 42, provided on both sides of the yoke unit 18, i.e. of the related coil unit 16, with related air gaps 44 and 46 and stationary yoke sections 48 and 50, the magnetic flux paths thus formed are configured such that, for example, as a result of a shorter gap separation distance 46 compared with the gap separation distance 44, the arm 42, 46, 50 has a lower magnetic resistance compared with the arm 40, 44, 48, so that while it is true that in the deactivated state of FIG. 8, in which just the permanent magnet flux (arrow bundle 52) passes through the yoke section 18, both armature arms remain without flux, when the coil 16 is energised in an analogous manner to the earlier described effect, the displacement and flux concentration of both the permanent magnetic flux 52 and also the coil magnetic flux 54 caused by the coil activation primarily takes place over the right-hand side armature arm, and therefore over the shorter air gap 46. This leads to the fact that it is the right-hand side air gap 46 that is firstly closed by the force correspondingly acting on the armature unit 42.

In the unit, by appropriate dimensioning of the effective flux cross-section of the arm formed from the units 42, 50, the latter by the increase of the magnetic flux into a magnetic saturation, there then takes place in turn, as shown in FIG. 10, a (partial) displacement of the flux into the arm formed from the armature unit 40, air gap 44 and yoke unit 48, as shown by the bundle of arrows 56; this flux is supplied essentially from components of the coil magnetic flux which, by means of the described saturation effect in the arm 42, 50 only runs to a limited extent via this arm and is then primarily displaced into the left-hand side arm 40, 48. The end result is that the air gap 44 is also closed.

Thus the example of embodiment of FIGS. 8 to 10 demonstrates that by a suitable design of respective flux-conducting circuits, i.e. flux-conducting arms, for example by means of suitable cross-sectional dimensioning of the flux-conducting yoke sections and/or configuration of the air gaps, a drive sequence can be established, i.e. achieved, for the respective armature units in the described example of embodiment, for example, such that the armature unit 42 moves firstly, and only subsequently does the armature unit 40 move.

The example of embodiment of FIGS. 11, 12 supplements the variant of FIGS. 8 to 10 with a second permanent magnet unit 21, which in accordance with the principles as represented is provided at the other end opposite the permanent magnet unit 20; the second permanent magnet unit 21 firstly generates an independent permanent magnetic flux 58 which, cf. FIGS. 10 and 11, is discernible as a reaction to the closure of the air gap 46 (i.e. saturation taking place in the related flux-conducting components 42, 50); this permanent magnetic flux 58 together with a component of the coil magnetic flux 56 (in an analogous manner to FIG. 10) is superposed on the working air gap 44, causing in this respect in the context of the inventive principle, a switched flux amplification and thus an influential effect.

FIGS. 13 to 15 describe a further example of embodiment of the present invention, in contrast to the above-described forms of implementation, which were rather schematically represented, these provide a typical example of how the respective flux-conducting components participating in the implementation of the schematically represented functionality can be configured. Thus, for example, the perspective representation shows how the yoke sections 22, 24 (as sections connecting the ends of the participating components in each case) can be suitably implemented from a stack of transformer sheets, typically stamped or similar, and thus combine the otherwise of known art beneficial vortex flow minimisation effects with advantageous flux conductivity and good suitability for a preferred form of suitable large-scale production.

The examples of embodiment of FIGS. 13 to 15 illustrate moreover, how by suitable positioning of the coil unit, or of a pair of permanent magnets relative to the movable armature unit, potentially disadvantageous gravitational force components on the armature unit can be reduced (as would otherwise typically be anticipated to be present in laterally outwardly mounted coil-armature combinations, and which can lead to wear, i.e. reduction of service life).

Thus, for example, the perspective representation of FIGS. 13 to 15 (wherein FIG. 14 illustrates just the permanent magnetic flux, and FIG. 15 illustrates the superposed permanent and coil magnetic fluxes), shows how a permanent magnetic short-circuit flux (FIG. 14) occurs outside the working air gap along the flux-conducting sheet stack 22, 24, while as illustrated in FIG. 15, by means of the introduction of flux on both or all sides in the direction towards the armature unit 10 (which interacts with a stationary yoke section, in the figures shown as concealed, with the formation of the working air gap) shows how a balance, i.e. equalisation, of the force components aligned in the plane of the respective flux-conducting sheet elements 22 and 24 occurs with regard to an axial direction of movement of the armature unit.

In an analogous manner to the above-described examples of embodiment (for example the representation of principles in FIG. 4 in comparison to FIG. 3) in the de-energised state of the coil (FIG. 14) there occurs the permanent magnetic flux through the yoke section 18 assigned to the coil 16, while in the energised state of the coil (FIG. 15) the coil magnetic field causes a flux displacement, i.e. displacement of the permanent and coil magnetic fields through the working air gap. For purposes of illustrating the principal common features for the above-described examples of embodiment equivalent reference symbols have been introduced into FIGS. 14 and 15.

The examples of embodiment in FIGS. 16 to 23 illustrate how by means of an arrangement of (a multiplicity of) respective permanent magnets and with suitably assigned, e.g. in pairs, coil units (together with in each case a yoke section related to a coil for purposes of short-circuiting of the related permanent magnetic fluxes in the de-energised state of the respective coil), numerous configurations and adaptation options for a respective case of embodiment exist and provide for a minimisation of transverse force in practically all coils. Thus, for example, the schematic plan views onto an arrangement in accordance with FIGS. 16 and 17, in which on both sides of a central armature unit 60 in each case a coil-permanent magnet pair consisting of a permanent magnet rod 62 or 64 and also a related coil unit 66 or 68, in each case again consisting of a yoke section and related winding, illustrate how in the de-energised form any permanent magnet influence shown in FIG. 16, by means of a short-circuit over a respective coil-yoke section is held apart from the armature, while in the energised state of the two coil units 66 and 68 shown in FIG. 17 the above-described displacement occurs of the permanent magnet fluxes of the permanent magnet unit 64 or 62 onto the armature unit (i.e. onto the air gap axially aligned with the latter, not shown in the figures).

Further variants, in an analogous manner to this approach, ensue from the pairs of configurations of FIGS. 18 (de-energised) and 21 (analogous topology, but energised), further variants in the form of the topologies are shown in FIGS. 19 and 20, only in the de-energised state. Here the solid black circles and squares symbolise respective permanent magnets 70 which, in an analogous manner to the representation of FIGS. 16, 17, extend axially in a direction perpendicular to the plane of the figure, while the solid white circles 72 in each case symbolise a yoke section extending parallel to the former together with the coil winding surrounding the latter, with an indication of the respective permanent magnetic fluxes and, in the case of FIG. 21, in the energised state.

Here the present invention is limited neither to the arrangements shown, nor to the numbers (2 or 3) of pairs of permanent magnets and coils, rather this classification scheme can be adapted and duplicated or multiplied in any manner, wherein in particular even the number of respective coil units (with related yoke sections) does not have to agree with the number of permanent magnets, as illustrated for example by the variants of FIGS. 22 and 23. However in the context of preferred examples of embodiment of the invention it is beneficial if the arrangement of the permanent magnets and the coils relative to the armature unit is symmetrical (more preferably if it is radially symmetrical), so that advantages can here be implemented against the background of an intended optimisation of transverse force.

In the form of embodiment of FIG. 22 it is in this regard sensible if all three magnetic sources (i.e. the pair of permanent magnets 70 and the coil unit 72) in the arrangement shown provide an equal magnetic field strength, so as not to allow any transverse forces to act on the armature unit. In the arrangement of FIG. 23, in which the pair of permanent magnets are arranged opposite one another with regard to the central armature axis, it is just the permanent magnetic flux that must be displaced out of the related coil-yoke section by the energisation of the coil 72, so as to generate in the present inventive manner an axial force by means of the permanent magnets. Again the transverse force is advantageously minimised by the symmetrical arrangement.

With the aid of FIGS. 24 to 31 in what follows a further aspect of the invention is described with examples of embodiment; here, in an alternative to the above described first aspect of the invention, the armature-air gap-stator arm is itself covered with a coil, wherein this aspect of the invention, in an interaction with a laterally outwardly mounted permanent magnet unit, increases the coil efficiency in an advantageous manner.

The appropriate principle together with the magnetic flux paths is shown by the comparison between FIGS. 24 and 25. Again connected at both sides and both ends by flux-conducting sections 22 and 24 at one end an elongated axially magnetised permanent magnet unit 20 is provided; at the other end and directly adjacent to the coil a yoke section 80 and 82 is provided in each case. Between the yoke sections 80 and 82 (which in the manner to be described in what follows are implemented by means of a suitable housing of the electromagnetic actuator) is provided, covered by a winding 16, a combination consisting of an armature unit 10 a yoke section 12 acting as a stator, and an air gap 14 provided in between.

Here in accordance with FIG. 24 in the de-energised state of the coil unit 16 a permanent magnetic flux 84 runs in accordance with the arrows as shown, namely in the centre of gravity through the proximal yoke section 82 and, with a reduced flux component (since further removed and thus with a somewhat higher magnetic resistance) through the distal yoke section 80.

The energisation of the coil unit 16, as shown schematically in FIG. 25, leads then to a resultant flux path in such a way, that, superposed with the permanent magnetic flux 84 now in the armature arm and displaced via the air gap 14 in addition a coil magnetic flux 86 runs in an additive and superposed manner, so that in the context of the present invention an introduction of force onto the armature unit 10 here takes place in an optimised manner.

FIGS. 26 to 31 illustrate possible implementations of this principle in the practical execution, wherein FIG. 26 shows a first example of design embodiment in the axially partially sectioned state, FIG. 27 shows the permanent magnetic flux in this arrangement and FIG. 28 shows a resultant magnetic flux path in the case of additional energisation of the coil unit in the design implementation in accordance with FIG. 26: In this example of embodiment the housing is implemented in the shape of a curve such that an outer lying permanent magnet 20 (of a pair 20, 21 engaging in both sides) is connected via the flux-conducting sections 22, 24 to the yoke sections 80 and 82, which in the example of embodiment represented are implemented via sections of the housing. For purposes of further illustration the reference symbols selected in FIGS. 26 to 31 correspond to those of FIGS. 24 and 25. It becomes apparent that with energisation of the coil unit (FIG. 28) the permanent magnetic flux 84 (in comparison to FIG. 27, in which in the de-energised state just a permanent magnetic short-circuit takes place via the housing wall 82) is displaced into the sequence of armature unit 10, air gap 14 and stator-yoke section 12 in which movement is effective.

As a variant to the form of embodiment in FIGS. 26 to 28 the example of embodiment in FIGS. 29 to 31 shows how the permanent magnet 20, instead of being superimposed from the exterior via a curved arrangement onto the cylindrical actuator housing, is introduced into a longitudinal slot 90 of this housing, whereby then, for purposes of implementation of the permanent magnetic short-circuit function in the de-energised state (FIG. 30), the permanent magnetic flux runs via the housing sections adjacent to the slot, while in the energised state of the coil unit and in accordance with the representation in FIG. 31, here again the flux displacement and superposition with the coil magnetic flux takes place.

All of these examples of embodiment have the advantage (compared with the above-described aspect of the invention) that the coil is covered over its total circumference by a magnetically conducting housing, which accordingly reduces undesirable stray fields. Through the variant of integration of the permanent magnet into the housing as shown, either in the context of a superimposed arrangement arranged from the exterior in accordance with FIG. 26, alternatively a variant introduced into the housing by means of a slot, it is possible in both cases to maintain the advantage of the closed housing. Here it is sensible to generate a high magnetic flux density in the housing by means of the electromagnets (coil unit with yoke section) so that the electromagnetic field does not only propagate locally on one side of the housing (and then the permanent magnetic flux remains maintained on a housing side) Also the described second aspect of the invention offers the advantage that the housing (or any from the exterior superimposed flux-conducting curve) can be implemented in a relatively thin manner, alone as a result of the displacement of the permanent magnetic flux already a relatively high magnetic flux occurs over the working air gap, so that the total magnetic flux in large parts of the housing can be low and correspondingly enables only low magnetically effective flux cross-sections.

While moreover this inventive principle can be implemented with just one permanent magnet element (as, for example, in the example of embodiment of FIG. 29) it is possible, for example, as in the example of embodiment of FIG. 26 with the permanent magnets sitting on both sides, suitably to provide a plurality of magnets and so again to be able to adapt to the arrangement of application conditions in each case provided.

The invention claimed is:

1. An electromagnetic actuator device, comprising a coil unit, which surrounds a first yoke section of a stationary yoke unit and is activated by energizing the coil unit, and an armature unit, which is guided so as to be movable relative to the stationary yoke unit and which performs an actuating movement, the armature unit interacts with at least one second yoke section of the yoke unit to form an air gap lying outside of the first yoke section for a magnetic flux produced by the coil unit when activated, a permanent magnetic unit connected magnetically in parallel to the coil unit such that a permanent magnetic flux of the permanent magnetic unit can pass through the first yoke section, wherein the permanent magnetic unit is magnetically in parallel with the at least one second yoke section, and the armature unit is positioned between the permanent magnetic unit and at least a portion of the coil unit, a coil magnetic flux of the coil unit flowing across the air gap is overlaid in a magnetically parallel and/or equally directed orientation in the same direction is superposed in a manner with a permanent magnet flux of the permanent magnetic unit flowing across the air gap, and the activated coil unit causes at least a partial magnetic flux shift comprising a magnetic flux displacement of the permanent magnetic flux of the permanent magnetic unit from the first yoke section into the second yoke section.

2. The device in accordance with claim 1, wherein the activation of the coil unit for purposes of causing the magnetic flux relocation is established in a permanent or pulsed form, and in the case of the pulsed form of activation causes monostable or bistable positioning of the armature unit with zero current in respective end positions.

3. The device in accordance with claim 1, wherein the at least one second yoke section is provided for the armature unit adjacent to an external cover of the coil unit.

4. The device in accordance with claim 1, wherein an axial direction of extension of an elongated design of the first yoke section is aligned parallel to a linear direction of movement of the armature unit and/or parallel to a magnetisation direction of the permanent magnetic unit, or the direction of movement and/or the magnetisation direction is tilted or inclined with regard to the axial direction of extension by an angle of not more than 10°.

5. The device in accordance with claim 1, wherein adjacent to an external cover of the coil unit, at least two of the second yoke sections are provided for purposes of interacting with two armature units such that the armature units, with regard to an axial direction of extension of the first yoke section are arranged on one side, on both sides and/or around a periphery of the coil unit, and are evenly distributed around the latter.

6. The device in accordance with claim 1, wherein the permanent magnetic unit comprises a multiplicity of permanent magnet units connected and/or polarised magnetically parallel to one another, which are of an elongated design extending along a permanent magnetisation direction and further are arranged spaced apart from one another with a magnetic interconnection of the first yoke section and/or the at least one second yoke section.

7. The device in accordance with claim 6, wherein the permanent magnet unit is arranged with regard to the second yoke section located opposite the coil unit such that a transverse force component of force on the armature unit, inclined by means of the activated coil unit relative to the movement longitudinal axis of the armature unit, is compensated or reduced.

8. The device in accordance with claim 7, wherein a multiplicity of permanent magnet units, in the form of individual magnets spaced apart from one another and arranged parallel to one another along a respective magnetisation direction, is provided in some sections around the periphery and/or in the form of a curve around the armature unit.

9. The device in accordance with claim 8, wherein the multiplicity of permanent magnet units with one or a multiplicity of individual coils of the coil unit, in pairs, is arranged around the armature unit such that it interacts with the coil unit.

10. The device in accordance with claim 1, wherein the first yoke section, the at least one second yoke section and the permanent magnet unit are connected with one another at both ends by flux-conducting elements and/or flux-conducting sections of the yoke unit as a magnetic parallel connection and/or a flux-conducting arrangement with at least two flux-conducting circuits.

11. The device in accordance with claim 10, wherein the flux-conducting elements and/or flux-conducting sections are designed such that they extend at right angles to a linear direction of movement of the at least one armature unit and/or to a magnetisation direction of the at least one permanent magnet unit and/or to a longitudinal direction of the first yoke section.

12. An electromagnetic actuator device comprising a coil unit enclosing a first yoke section of a stationary yoke unit, and which can be activated by means of energisation, and an armature unit moveably guided relative to the yoke unit for purposes of executing a positioning movement, the armature unit being at least partially enclosed by the coil unit, and interacting with the first yoke section with the formation of an air gap for a magnetic flux generated by the coil unit, a flux-conducting section of the yoke unit outside the first yoke section is assigned to the coil unit for the formation of at least one magnetic flux path that is free of air gaps, a permanent magnetic unit connected magnetically parallel to the coil unit such that in a de-energised state of the coil unit a permanent magnetic flux of the permanent magnetic unit is guided over the flux-conducting section, in the form of a magnetic short-circuit, wherein the permanent magnetic unit is also magnetically in parallel with the first yoke section, and the armature unit is between the permanent magnetic unit and at least a portion of the coil unit, and wherein the coil unit when activated causes an at least partial magnetic flux relocation or displacement of the permanent magnetic flux from the flux-conducting section of the yoke unit into the first yoke section, and also across the air gap.

13. The device in accordance with claim 12, wherein the flux-conducting section forms two flux-conducting arms running magnetically parallel to one another, which in each case are provided adjacent to the coil unit on the cover side, and are arranged opposite one another with regard to the coil unit.

14. The device in accordance with claim 13, wherein the flux-conducting section is designed as a section of a flux-conducting housing shell of the actuator device, which encloses the coil unit on the cover side, wherein the permanent magnetic unit is provided on and/or in the housing shell, and aligned such that a magnetisation direction of the permanent magnetic agents runs parallel to a direction of movement of the armature unit.

15. The device in accordance with claim 14, wherein the permanent magnetic unit is external on the housing shell in order to interact with the flux-conducting section via flux-conducting connection agents.

16. The device in accordance with claim 14, wherein the permanent magnetic unit is accommodated for purposes of interacting with the flux-conducting section in an elongated and/or slot-shaped opening and/or gap in the housing shell.

17. The device in accordance with claim 12, wherein the permanent magnetic unit comprises a multiplicity of permanent magnet units aligned parallel to one another along its magnetisation direction, which are further spaced apart from one another and assigned to respective flux-conducting arms.

18. The device in accordance with claim 17, wherein the first yoke section and the permanent magnetic units are designed at both ends with flat connecting flux-conducting sections of the yoke unit or have a flat side and are implemented in terms of an arrangement.

* * * * *